United States Patent [19]

Yokosawa

[11] Patent Number: 4,519,121

[45] Date of Patent: May 28, 1985

[54] METHOD OF AND APPARATUS FOR MOUNTING PLATE FINS OF HAIRPIN PIPES

[75] Inventor: Tomoo Yokosawa, Chiisagata, Japan

[73] Assignee: Hidaka Seiki KK, Japan

[21] Appl. No.: 546,672

[22] Filed: Oct. 28, 1983

[30] Foreign Application Priority Data

Nov. 30, 1982 [JP] Japan ..... 57-208504

[51] Int. Cl.[3] ..... B21D 53/02

[52] U.S. Cl. ..... 29/157.3 C; 29/33 K; 29/157.3 B

[58] Field of Search ..... 165/151; 29/157.3 B, 29/157.3 A, 157.3 R, 157.3 C, 33 G, 33 K, 33 T, 33 Q, 33 S, 564.2, 564.8; 198/486, 689

[56] References Cited

U.S. PATENT DOCUMENTS

| | | | |
|---|---|---|---|
| 2,247,730 | 7/1941 | O'Brien | 29/33 G X |
| 2,688,178 | 9/1954 | Boyd et al. | 29/33 G |
| 3,089,226 | 5/1963 | Szöts et al. | 29/157.3 B |
| 3,179,236 | 4/1965 | Bower | 198/648 X |
| 3,292,689 | 12/1966 | Kimura | 29/157.3 B X |
| 3,482,299 | 12/1969 | Davidson et al. | 29/157.3 B |
| 4,228,993 | 10/1980 | Cathers | 198/486 X |

*Primary Examiner*—Mark Rosenbaum
*Assistant Examiner*—John T. Burtch
*Attorney, Agent, or Firm*—McGlew and Tuttle

[57] ABSTRACT

A web punched by a fin press and continuously fed therefrom is intermittently fed by increments equal to a desired number of tiers of punched holes in the web into a space below a pressure plate. The web is then held under suction by the pressure plate and cut off by a cutter into a plate fin. The pressure plate with the cut-off plate fin held thereby is horizontally fed along an interval in the direction in which the web is fed. The plate fin then is released from the pressure plate so as to drop onto a mobile carriage below the pressure plate until hairpin pipes carried by the mobile carriage in upstanding disposition are inserted through the punched holes in the plate fin. The pressure plate moves back to its original position. The above cycle of operation is repeated until a prescribed number of plate fins are fitted over the hairpin pipes. Thereafter, the pressure plate is lowered to depress the plate fins for thereby stacking the plate fins on the hairpin pipes.

2 Claims, 16 Drawing Figures

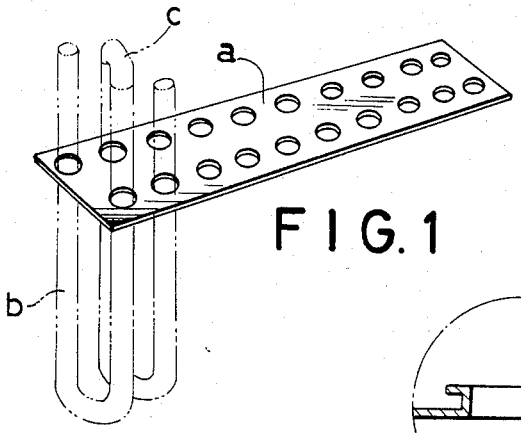
FIG. 1
FIG. 2
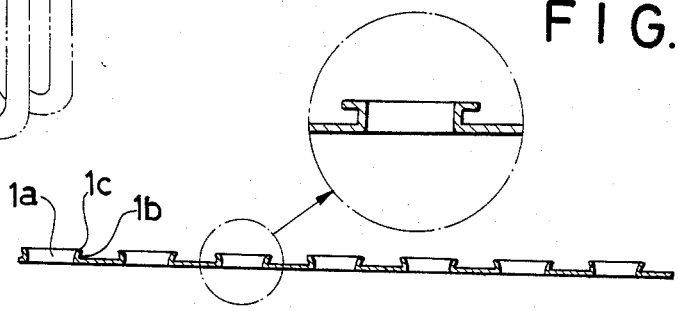
FIG. 6
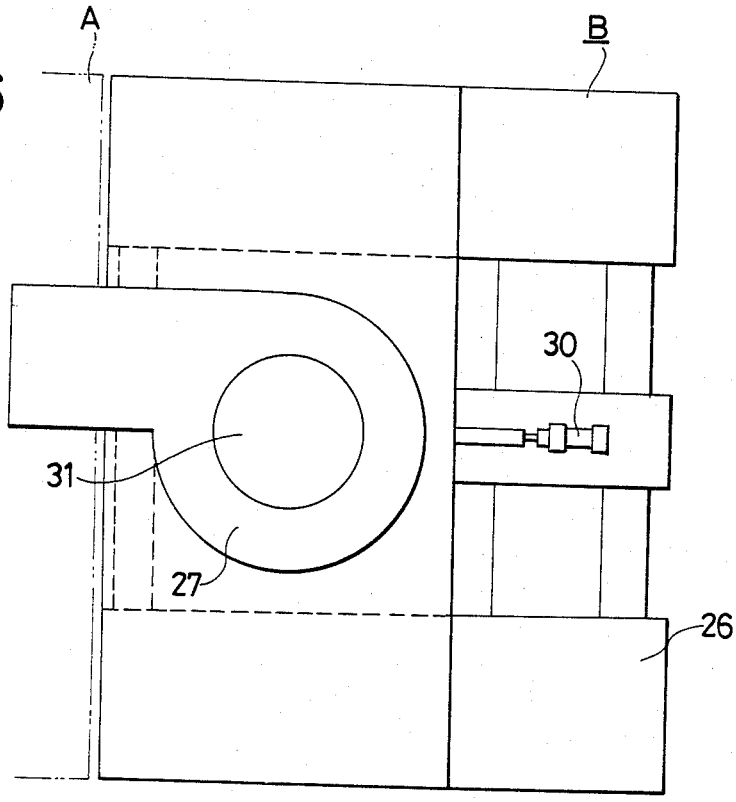

METHOD OF AND APPARATUS FOR MOUNTING PLATE FINS OF HAIRPIN PIPES

BACKGROUND OF THE INVENTION

1. Field of the Invention

The present invention relates to a method of and an apparatus for mounting plate fins on hairpin pipes during assembly of heat exchanger fins.

2. Description of the Prior Art

As shown in FIG. 1 of the accompanying drawings, fins in heat exchangers have heretofore been assembled by stacking a multiplicity of plate fins a that have been punched by a fin press (not shown), inserting a multiplicity of U-shaped hairpin pipes b of copper through the stacked plate fins a, and then interconnecting the upper open ends of the hairpin pipes b with U bends c, thereby providing a continuous passage through the hairpin pipes b and the U bends c. Heat exchanger fins have typically had 36 sets of 250 through 320 plate fins a securely joined in a stacked form by the hairpin pipes b.

Each of the plate fins a is produced by punching a thin rectangular sheet of aluminum having a width of 19 mm and a length of 200 mm, for example. As illustrated in FIG. 2, nine to ten holes 1*a* are defined in the plate fin a and have peripheral edges raised to provide fin collars 1*b* and free edges bent outwardly to provide flares 1*c*. These holes 1*a* are arranged in a zigzag row, and those holes 1*a* which are located close to one edge of the plate fin have edges spaced from the edge of the plate fin by small distances which are 1 to 2 mm at minimum.

When the hairpin pipes b are inserted through the holes 1*a* in the plate fins a, the plate fins a are stacked at mutually spaced relation with the fin collars 1*b* serving as spacers. Each hole 1*a* has a diameter which is about 0.3 mm larger than the outside diameter of the hairpin pipes b. After the plate fins a have been mounted on the hairpin pipes b, both of the open ends of each hairpin pipe b are flared toward the curved end thereof in order to secure the plate fins a to the hairpin pipes b. Since the plate fins a are in the form of thin sheets, they are liable to be bent or otherwise deformed. Therefore, the plate fins a have conventionally been mounted on the hairpins b exclusively manually as it has been difficult to automatize the operation to mount the plate fins a on the hairpin pipes b. More specifically, the hairpin pipes b have been manually inserted through the holes in the plate fins a arranged in lateral alignment. The prior assembling procedure has therefore required an increased expenditure of labor and time.

According to another assembling practice, plate fins which have been punched by a fin press are temporarily stacked on a stacker, and then picked up and arranged in mutual alignment so that a few or all hairpins can be inserted through the plate fins in a separate assembling step. This prior assembling procedure, however, is disadvantageous in that it is difficult to pick up a variety of different types of plate fins, and a mechanism for aligning the picked-up plate fins is quite complex in construction.

SUMMARY OF THE INVENTION

Accordingly, it is an object of the present invention to provide a method of and an apparatus for automatically and successively mounting plate fins on hairpin pipes without manual intervention.

According to the present invention, there is provided a method of mounting plate fins having punched holes on hairpin pipes, comprising the steps of (a) placing a multiplicity of hairpin pipes in upstanding disposition with open ends thereof directly upwardly in a mobile carriage in spaced relation at the same interval as that of the punched holes in the plate fins, (b) thereafter positioning the mobile carriage in a position for mounting the plate fins on the hairpin pipes, (c) aligning tiers of punched holes in a web which has been continuously fed along from a fin press, (d) moving the web past a cutter blade by a distance equal to a desired number of tiers of punched holes in the web while the web is being held under suction by a pressure plate, (e) cutting the web into a plate fin with the cutter blade while the web is being held under suction by a pressure plate, (f) moving the pressure plate with the cut-off plate fin held thereby horizontally in a direction away from the cutter, (g) releasing the plate fin from the pressure plate to allow the plate fin to drop onto the mobile carriage until the hairpin pipes are inserted through the punched holes in the plate fin, (h) moving the pressure plate back to the original position prior to the movement away from the cutter blade, (i) repeating the steps (c) through (h) a predetermined number of times, (j) lowering the pressure plate from the original position to depress the plate fins along the hairpin pipes toward the lower ends thereof, and (k) repeating the steps (c) through (j) until a prescribed number of plate fins are stacked on the hairpin pipes.

According to the present invention, there is further provided an apparatus for mounting plate fins having punched holes on hairpin pipes, comprising a mobible carriage for carrying a multiplicity of hairpin pipes in upstanding disposition with open ends thereof directly upwardly in spaced relation at the same interval as that of the punched holes in the plate fins, a plate fin feeder for intermittently feeding a web which has been continuously fed along from a fin press by increments equal to tiers of punched holes in the web while aligning the tiers of punched holes, a plate fin cutter having a cutter blade for cutting off the web into a plate fin, and a plate fin mounting device having a pressure plate for holding under suction a portion of the web having moved past the cutter blade, the plate fin mounting device being operable to move the pressure plate with the cut-off plate fin held thereby horizontally in a direction away from the cutter blade, then to release the plate fin to allow the latter to drop from the pressure plate onto the movable carriage until the hairpin pipes are inserted through the punched holes in the plate fin, to move the pressure plate back to a position prior to the movement away from the cutter blade, to lower the pressure plate to depress the plate fins along the hairpin pipes toward the lower ends thereof after a predetermined number of plate fins have been fitted over the hairpin pipes, thereby stacking the platefins successively on the hairpin pipes.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 1 is a perspective view of a plate fin;

FIG. 2 is a longitudinal cross-sectional view of the plate fin shown in FIG. 1;

FIG. 6 a plan view of a plate fin mounting device;

DESCRIPTION OF THE PREFERRED EMBODIMENT

Figure 3:
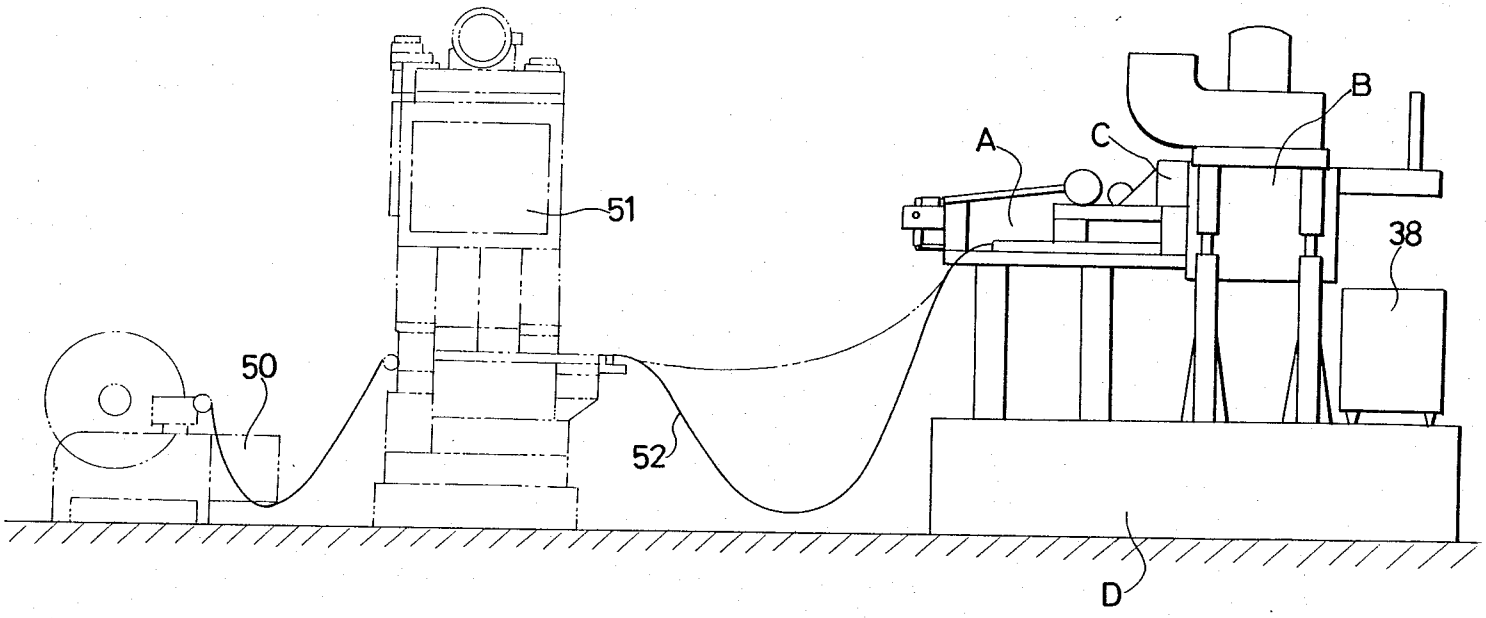
FIG. 3 is a side elevational view of an apparatus for mounting plate fins on hairpin pipes in accordance with the present invention.

As shown in FIG. 3, an apparatus for mounting plate fins on hairpin pipes according to the present invention comprises a mobile carriage 38 for carrying a multiplicity of hairpin pipes spaced at the same interval as that of certain tiers of holes in plate fins with the open ends of the hairpin pipes being directed upwardly, a plate fin feeder A for feeding a web punched by a fin press and continuously delivered from the fin press in an intermittent fashion for intervals equal to a prescribed number of punched holes with the punched holes kept in alignment, and a plate fin cutter C for cutting off the web into plate fins. The apparatus also includes a plate fin mounting device B having a pressure plate for holding under suction a portion of a plate fin which has passed under the cutter blade of the plate fin cutter C. The plate fin mounting device B operates by horizontally moving slightly the pressure plate with the severed plate fin held thereon in a direction away from the cutter blade, then releasing the plate fin to allow the latter to drop until it fits over the hairpin pipes carried by the mobile carriage 38 positioned below the pressure plate, moving the pressure plate back to the original position, and lowering the pressure plate to place the plate fins successively along the hairpin pipes toward their lower ends after a prescribed number of plate fins have been mounted on the hairpin pipes, thus stacking the plate fins on the hairpin pipes. The apparatus further includes a base table D supporting thereon the plate fin feeder A, the plate fin cutter C, and the plate fin mounting device B, and having in its upper surface a closed rectangular passage along which the mobile carriage 38 is movable.

The plate fin feeder A, the plate fin mounting device B, the plate fin cutter C, the base table D, and the mobible carriage 38 will now be described.

Figure 4:
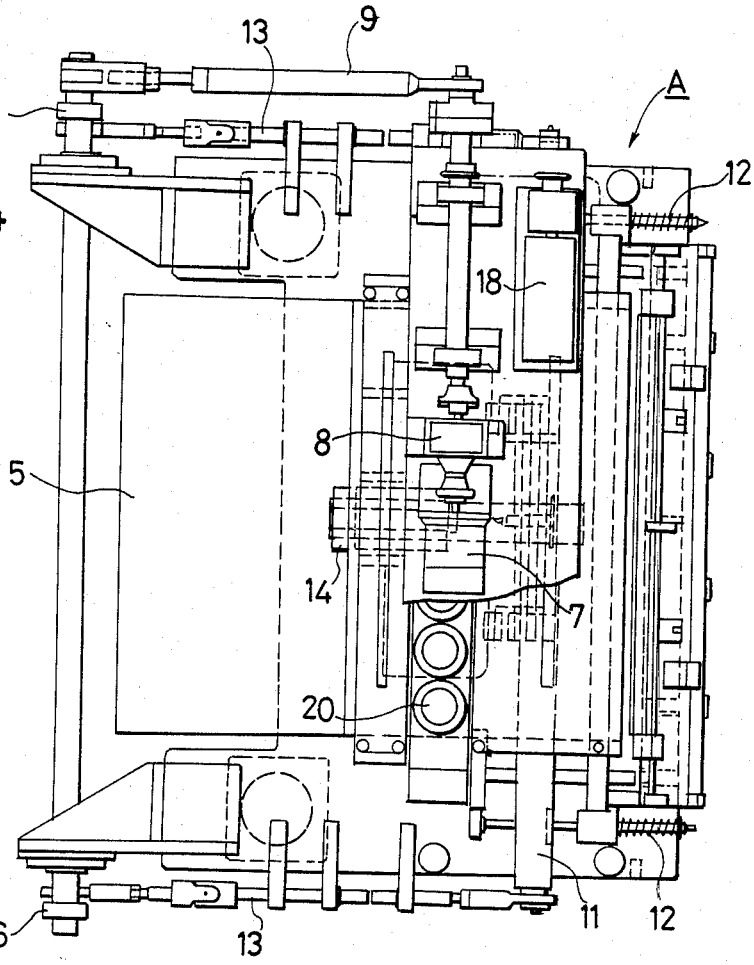
FIG. 4 is a plan view of a plate fin feeder and a plate fin cutter in the apparatus of FIG. 3.
Figure 5:
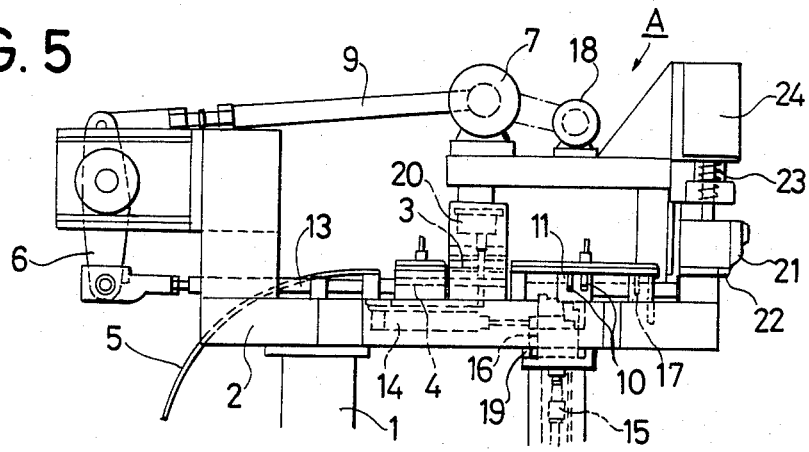
FIG. 5 is a side elevational view of the plate fin feeder and plate fin cutter shown in FIG. 4.

The plate fin feeder A and the plate fin cutter C will first be described with reference to FIGS. 4 and 5. The plate fin feeder A comprises various mechanisms attached to a base frame 2 supported on the base table D by base posts 1. A plate-fin-forming web 52 punched by a fin press 51 (FIG. 3) and continuously fed therefrom is supported and guided by a guide plate 5 and moves forward (to the right as shown) while passing between upper and lower plates 3, 4. A slidable base 11 in the form of a rectangular bar is mounted on the base frame 2 and has on its upper surface a multiplicity of laterally disposed pairs of front and rear feed fingers 10. The slidable base 11 is normally moved in the rearward direction by springs 12. Swingable links 6 are pivotably supported on the base frame 2 for back-and-forth angular movement by a crank rod 9 coupled to a rotatable shaft which can be rotated by a motor 7 through a speed reducer 8. The slidable base 11 is movable forward (to the right as illustrated) by link rods 13 coupled to the swingable links 6 against the bias of the springs 12. Any vibrations of the slidable base 11 due to the springs 12 are taken up by a damper 14. The pairs of front and rear feed fingers 10 are located at the same pitch as that of the tiers of spaced holes in the plate-fin-forming web 52 for engagement in the holes to move the web 52 forward in unison with the slidable base 11. When the slidable base 11 returns, the feed fingers 10 are disengaged from the web 51 being pushed thereby. The lower plate 4, which is engageable with the front of the feed fingers 10, has thereon a row of laterally arranged check fingers 17.

The plate fin cutter C is disposed forward (to the right as shown) of the base frame 2, and comprises a cutter blade 21, dies 22, a spring 23, and a hydraulic cylinder 24. The web 52 is caused by the plate fin feeder A to pass below the plate fin cutter C and move forward for an interval equal to a prescribed number of tiers of punched holes in the web 52. Thereafter, the web 52 is cut off into a plate fin by the cutter blade 21 depressed by the hydraulic cylinder 24 against the resiliency of the spring 23.

The interval at which the web 52 is fed by the feed fingers 10 of the plate fin feeder A in one operation is equal to four tiers of punched holes in the web 52. This produces plate fins each having a number of hole tiers equal only to a multiple of 4. When it is necessary to produce a plate fin having nine hole tiers, the web 52 should be fed twice by a four-tier feeding movement and then once by a one-tier feeding movement. For producing a plate fin having ten hole tiers, the web 52 should be fed twice by four-tier feeding movement, followed by a single two-tier feeding movement. A plate fin having eleven hole tiers can be produced by feeding the web 52 twice by a four-tier feeding movement and then by a three-tier feeding movement. The slidable base 11 is movable by a mechanism including a feed distance adjustment plate 16 movable upwardly and downwardly by a hydraulic cylinder 15 to adjust the single feeding movement of the web 52 to a four-tier, three-tier, two-tier, or one-tier distance, so that the web 52 can be fed to a distance equal to any desired number of hole tiers. More specifically, the feed distance adjustment plate 16 has a stepped upper surface, and stoppers 19 having heights corresponding to the feed distances are selectively interposed between the feed distance adjustment plate 16 and the base frame 2, thereby selecting one of the four-tier feeding movement, the four-tier and one-tier feeding movement, the four-tier and two-tier feeding movement, or the four-tier and three-tier feeding movement. The upper plate 3 has on its upper surface a bellows-diaphragm cylinder 20 including an air-filled rubber bag having a bottom acting through a pneumatic cylinder to guide each hole in the web at the time the latter is held at rest, thus preventing the web 52 from being moved around.

The feed distance adjustment plate 16 and the bellows-diaphragm cylinder 20 are driven in their vertical movement under the control of a rotary cam 18 rotated by the motor 7 and a control device (not shown).

Figure 7:
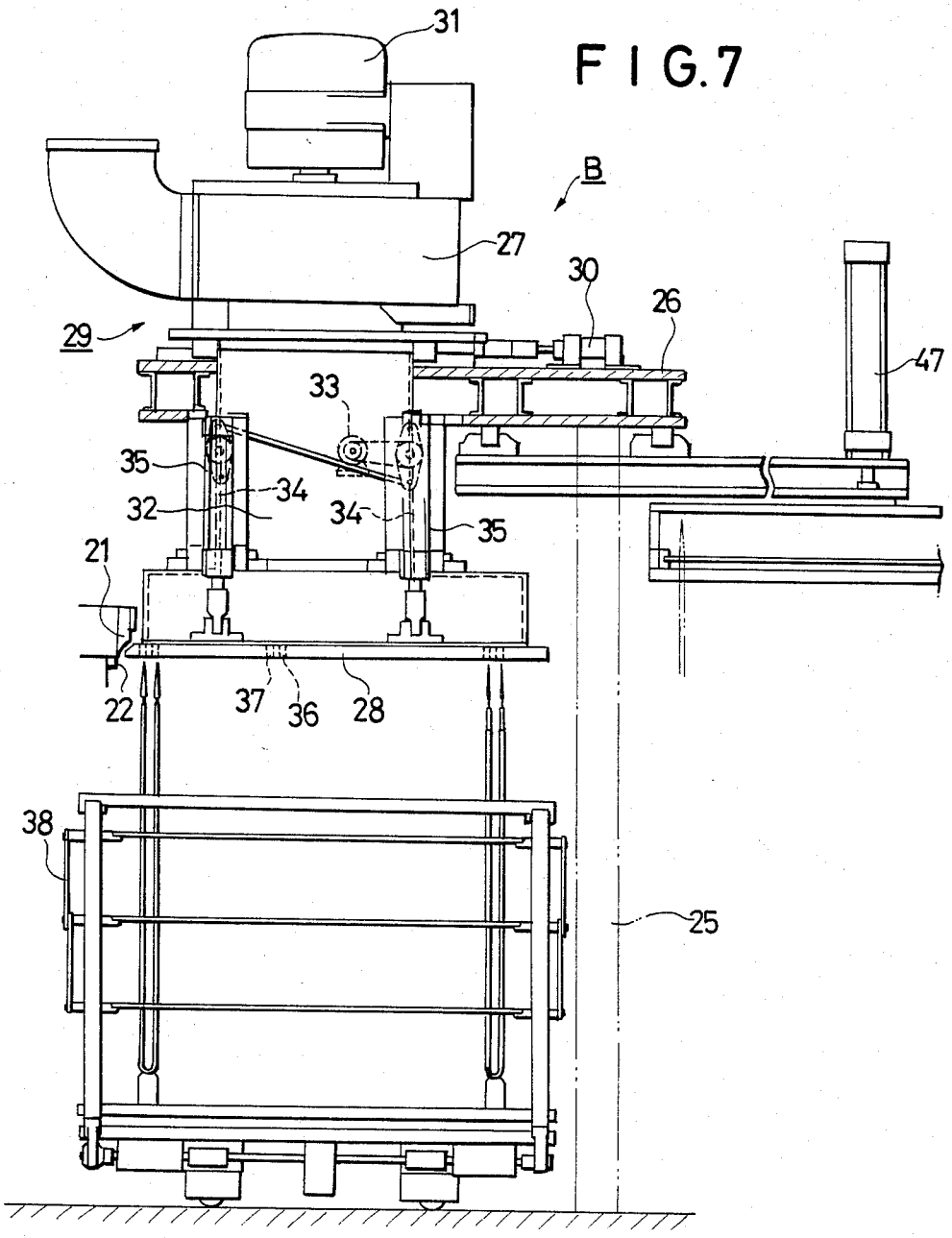
FIG. 7 is a side elevational view of the plate fin mounting device of FIG. 6 and a mobile carriage.
Figure 8A:
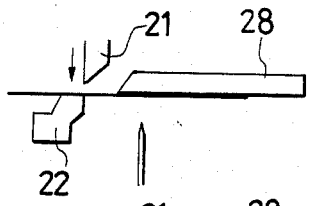
FIGS. 8(*a*)–8(*f*) illustrate the progressive steps of mounting plate fins on hairpin pipes, including the step of feeding the plate fins up to the step of displacing the plate fins onto hairpin pipes.
Figure 8B:
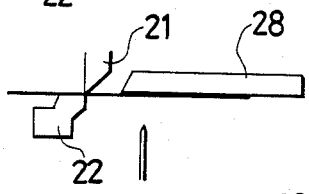
Figure 8C:
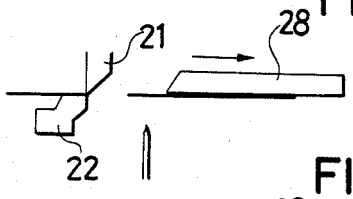
Figure 8D:
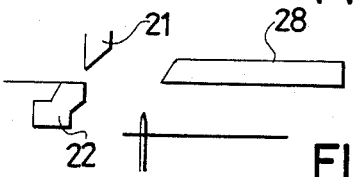
Figure 8E:
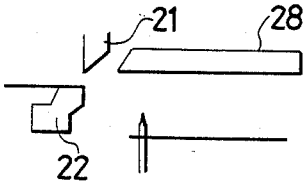
Figure 8F:
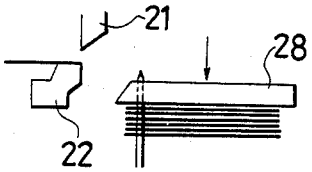

The plate fin mounting device B and the mobile carriage 38 will next be described with reference to FIGS. 6 and 7. The plate fin mounting device B is securely placed on a base frame 26 mounted on support posts 25 standing on the base table D. The plate fin mounting device B comprises a plate fin attracting and depressing mechanism 29 having a pressure plate 28 for attracting and depressing a plate fin, and a blower 27 serving as an air source for attracting the plate fin. The plate fin attracting and depressing mechanism 29 is horizontally movable by a pneumatic cylinder 30 mounted on the base frame 26 for a distance of about 20 mm forward from the position in which a plate fin is cut off the web 52. The reason for moving the plate fin attracting and depressing mechanism 29 in the forward direction will be described below. The blower 27 is drivable by a motor 31 and has a lower pressure-reduction chamber 32 with a multiplicity of small holes defined in its bottom and positioned adjacent to an upper surface of the pressure plate 28 in alignment with small suction holes (described below) in the pressure plate 28. The pressure-reduction chamber 32 has an air damper 34 openable and closable by a rotary actuator 33. The pressure plate 28 can be lifted and lowered by hydraulic cylinders 35 attached to the pressure-reduction chamber 32 adjacent to its fixed end. The pressure plate 28 has a multiplicity of holes 36 having the same size as that of the punched holes in the plate fin and arranged at the same pitch as that of the punched holes, and a multiplicity of small holes 37 provided between the holes 36 for attracting the plate fin. When the web 52 is fed by the plate fin feeder A by an interval corresponding to a prescribed number of hole tiers into the space below the pressure plate 28, the air damper 34 is closed to enable the blower 27 to attract the web 52 against the lower surface of the pressure plate 28. The web 52 then is served into a plate fin. The plate fin attracting and depressing mechanism 29 with the cut plate fin attracted and held thereby is moved forward (to the right in FIG. 7) about 20 mm. Thereafter, the air damper 34 is opened to release the plate fin, which is allowed to drop onto guide pins b' (FIG. 9) on the hairpin pipes b carried in upstanding disposition by the mobile carriage 38. The foregoing cycle of operation is repeated a prescribed number of times, and then the pressure plate 28 is lowered to depress cut plate pins downwardly along the hairpin pipes b.

Figure 9:
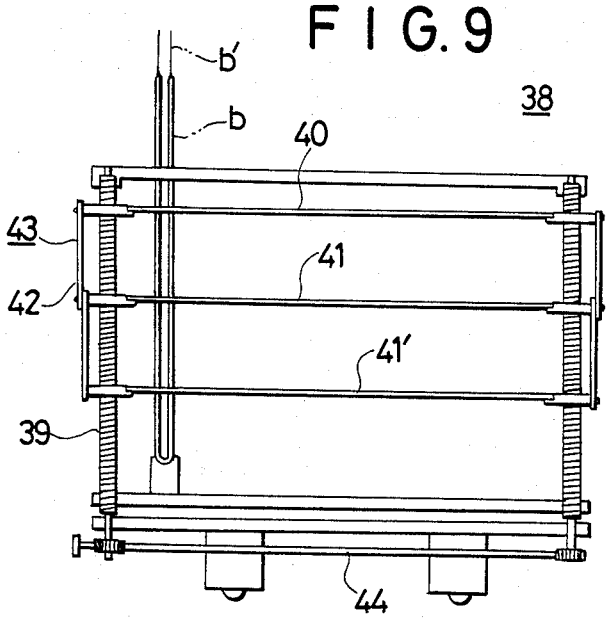
FIG. 9 is a side elevational view of the mobile carriage.

As shown in FIG. 9, the mobile carriage 38 in which the hairpin pipes b are erected and disposed at the same pitch has three holder plates 40, 41, 41' for holding the hairpin pipes b in an upright position, the mobile carriage 38 being movable on the base table D. The mobile carriage 38 includes upstanding feed ball screws 39 located at corners thereof with only the uppermost holder plate 40 being threaded over the feed ball screws 39. The lower holder plates 41, 41' depend from the uppermost holder plate 40 through connector plates 43 having oblong holes 42. The feed ball screws 39 are simultaneously rotatable by shafts 44 mounted on a lower portion of the mobile carriage 38, the shafts 44 being drivable by a driving device (not shown). As the ball screws 39 are rotated, the uppermost holder 40 is lowered into engagement with the lower holder plate 41, and they are lowered together until the lower holder plate 41 engages the lowermost holder plate 41'. Then, all of the holder plates 40, 41, 41' are moved downwardly in unison. By thus successively lowering the holder plates 40, 41, 41', the plate fins can be stacked successively from the lower portions of the hairpin pipes b.

Figure 10:
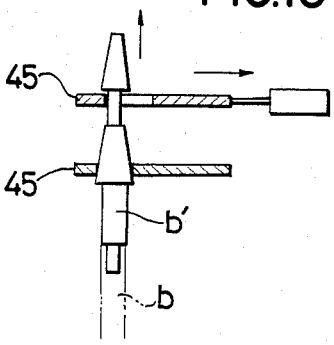
FIG. 10 is a view showing operation of a guide pin withdrawal mechanism.

As shown in FIG. 10, the guide pins b', which are arrowheaded in shape, are inserted in the upper ends of the hairpin pipes b carried upright by the mobile carriage 38 for facilitating the fitting engagement of the plate fins with the hairpin pipes b. After the plate fins have been mounted on the hairpin pipes b, two plates 45 having a multiplicity of engagement holes are fitted over the guide pins b', and then one of the plates 45 is pulled horizontally by a cylinder until the necks of the guide pins b' engage the engagement holes in the plate 45. Then, the plate 45 is lifted by another cylinder 47 (FIG. 7) to pull all of the guide pins b' out of the hairpin pipes b at the same time.

The plate fin attracting and depressing mechanism 29 is horizontally movable by about 20 mm in the direction in which the plate fins are fed along, for the following reason: Since the punched holes in the plate fin are located close to an edge thereof, the hairpin pipes to be inserted through these holes must be disposed close to the dies. However, there is no space available for positioning the hairpin pipes close to the dies. With the arrangement of the invention, the hairpin pipes are displaced slightly forward (to the right in FIG. 7) of the corresponding holes in the web. After attracting, holding and cutting off a plate fin, the pressure plate 28 is moved forward by about 20 mm, and then the plate fin is released onto the hairpin pipes. Thereafter, the pressure plate 28 returns to the original position. The pressure plate 28 goes through the above cycle of operation several times, and then is lowered to depress the plate fins along the hairpin pipes.

Such a sequence of operation will be described in greater detail with reference to FIGS. 8(*a*) through 8(*f*).

(1) The web is fed along while being attracted by the pressure plate 28, and stopped after a prescribed number of hole tiers have exceeded the cutting position (FIG. 8(*a*)).

(2) The cutter blade 21 is lowered to cut off the web into a plate fin (FIG. 8(*b*)).

(3) The pressure plate 28 with the cut-off plate fin attracted thereagainst is horizontally moved forward by about 20 mm (FIG. 8(*c*)).

(4) The air damper 34 is opened to release the plate fin, which is then allowed to drop from the pressure plate 28 and fit over a hairpin pipe located directly below (FIG. 8(*d*)).

(5) The pressure plate 28 moves back horizontally by about 20 mm to the original position (FIG. 8(*e*)).

The process now goes back to the step (1) and a predetermined number of cycles are repeated to cut off and stack plate fins on the hairpin pipe. The feeding of the web then is interrupted, and the pressure plate 28 is moved by the hydraulic cylinders 35 (FIG. 7) from the position of FIG. 8(*e*)) downwardly to depress the plate fins toward the lower end of the hairpin pipe until the plate fins are neatly stacked. Thereafter, the pressure plate 28 is raised to reinstate the cycle of operation from the step (1).

When all of the necessary plate fins are mounted on the hairpin pipes through the repetition of the above sequence, the entire operation is automatically brought to an end. Operation of the parts of the plate fin mounting device B is sequentially performed under programmed control by the rotary cam 18 in coaction with the plate fin feeder A and the plate fin cutter C.

Figure 11:
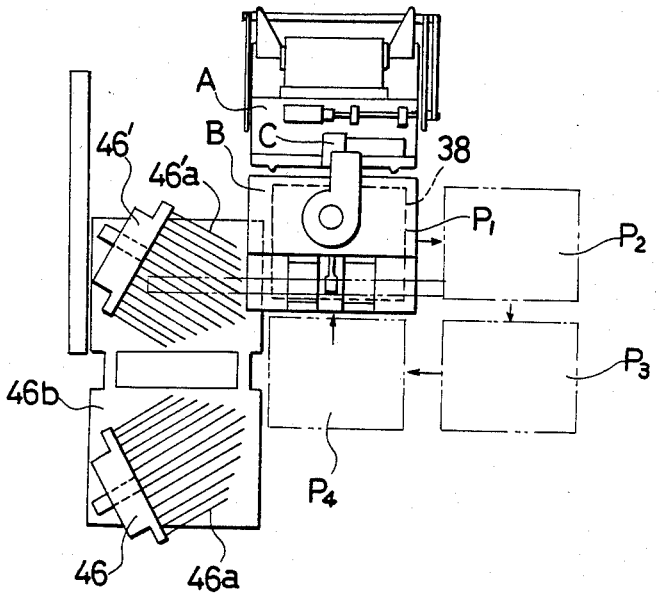
FIG. 11 is a plan view of the overall apparatus, showing movement of the mobile carriage.

After the plate fins have been successively stacked on the hairpin pipes in the mobile carriage 38, the mobile carriage 38 is moved to another location, and another mobile carriage 38 carrying hairpin pipes in upstanding disposition is set in predetermined position below the plate fin mounting device B. Accordingly, assemblies of plate fins and hairpin pipes can be manufactured in succession. While the mobile carriage 38 may manually moved, it can be moved by a device as shown in FIG. 11. More specifically, the base table D has V-shaped grooves defining a rectangular guide way for guiding four bearings mounted on the bottom of the mobile carriage 38 in successive and intermittent movement from a position $P_1$ to a position $P_2$ to a position $P_3$ to a position $P_4$ and back to the position $P_1$. In the position $P_1$, the plate fins are mounted on the hairpin pipes carried by the mobile carriage 38. After completion of the mounting of the plate fins, the mobile carriage 38 is moved to the position $P_2$ in which no action is effected on the mobile carriage 38 or the assembly of plate fins and hairpin pipes. Then, the mobile carriage 38 is moved to the position $P_3$ in which the guide pins b' are pulled out of the hairpin pipes, and the assembly of plate fins and hairpin pipes is manually removed from the mobile carriage 38. The empty mobile carriage 38 is then placed in the position $P_4$ in which a new set of hairpin pipes is placed in an erect position in the mobile carriage 38. Thereafter, a pair of hairpin pipe positioners 46, 46' is actuated to correct the hairpin pipes out of a tilted position so that the open ends of the hairpin pipes will be spaced at a prescribed pitch (which is the same as that of the punched holes in the plate fins). More specifically, the hairpin pipe positioners 46, 46' are mounted on a mobable table **46*b* and have a multiplicity of shafts 46*a*, 46'*a* extending horizontally and obliquely and spaced at predetermined distances. When the hairpin pipe positioners 46, 46' are operated, the shafts 46*a*, 46'*a* enter between the upright hairpin pipes carried by the mobile carriage 38 to correct the hairpin pipes out of the tilted position. Thereafter, the guide pins that have been removed in the position $P_3$ are inserted again into the hairpin pipes. The mobile carriage 38 and the hairpin pipe positioners 46, 46' are driven by the movable table 46*b* to bring the mobile carriage 38 into the position $P_1$ wherein plate fins start being mounted on the hairpin pipes again. After a first set of plate fins has been mounted on the hairpin pipes, the shafts 46*a*, 46'*a* of the hairpin pipe positioners 46, 46' are retracted to release the hairpin pipes. Plate fins are then successively mounted on the hairpin pipes which are supported by the holder plates 40, 41, 41'. The mobile carriage 38 can be moved from $P_1$ to $P_2$ to $P_3$ to $P_4$ by pushers (not shown) and stopped in these positions by dampers (not shown). A plurality of such mobile carriages 38** are provided on the guide way to effect the above operation successively.

As shown in FIG. 3, the apparatus for mounting plate fins on hairpin pipes is employed together with the fin press 51 which is known in the art. The plate fin cutter in the fin press is removed in advance so that the punched web can be introduced directly into the plate fin feeder A of the invention. More specifically, a blank web as reeled out by an uncoiler 50 is punched by the fin press 51, and the punched web is led continuously into the plate fin feeder A. The time required for the plate fin feeder A to intermittently feed the punched web 52 is selected to be about twice the time it takes for the fin punch 51 to feed the punched web 52 continuously, so that the web 52 will be slackened to a constant range at all times for smooth delivery of the punched web 52 into the plate fin feeder A.

With the arrangement of the present invention, the punching of a blank web on the conventional fin press is followed by successive and automatic steps of operation including severance of the punched web into plate fins up to mounting the plate fins onto hairpin pipes. This saves much labor in the assembling operation, and increases the rate of production of heat exchanger fins.

Although a certain preferred embodiment has been shown and described, it should be understood that many changes and modifications may be made therein without departing from the scope of the appended claims.

What is claimed is:

1. A method of mounting plate fins having punched holes on hairpin pipes, comprising the steps of:

(a) placing a multiplicity of hairpin pipes in upstanding disposition with open ends thereof directly upwardly in a mobile carriage in spaced relation at the same interval as that of the punched holes in the plate fins;

(b) thereafter positioning said mobile carriage in a position for mounting the plate fins on the hairpin pipes;

(c) aligning tiers of punched holes in a web which has been continuously fed along from a fin press;

(d) moving said web past a cutter blade by a distance equal to a desired number of tiers of punched holes in the web while said web is being held under suction by a pressure plate;

(e) cutting said web into a plate fin with said cutter blade while said web is being held under suction by a pressure plate;

(f) moving said pressure plate with the cut-off plate fin held thereby horizontally in a direction away from said cutter blade;

(g) releasing said plate fin from said pressure plate to allow said plate fin to drop onto said mobile carriage until said hairpin pipes are inserted through the punched holes in the plate fin;

(h) moving said pressure plate back to an original position prior to the movement away from said cutter blade;

(i) repeating said steps (c) through (h) a predetermined number of times;

(j) lowering said pressure plate from said original position to depress said plate fins along said hairpin pipes toward lower ends thereof; and (k) repeating said steps (c) through (j) until a prescribed number of plate fins are stacked on said hairpin pipes.

2. An apparatus for practicing the method of mounting plate fins having punched holes on hairpin pipes as setforth in claim 1, comprising:

(a) a mobile carriage for carrying a multiplicity of hairpin pipes in upstanding disposition with open ends thereof directly upwardly in spaced relation at the same interval as that of the punched holes in the plate fins;

(b) a plate fin feeder for intermittently feeding a web which has been continuously fed along from a fin press by increments equal to the number of tiers of punched holes in said web while aligning said tiers of punched holes;

(c) a plate fin cutter having a cutter blade for cutting off said web into a plate fin; and (d) a plate fin mounting device having a pressure plate for holding under suction a portion of the web having moved past said cutter blade, said plate fin mounting device being operable to move said pressure plate with the cut-off plate fin held thereby horizontally in a direction away from said cutter blade, then to release said plate fin to allow the latter to drop from said pressure plate onto said movable carriage until said hairpin pipes are inserted through the punched holes in the plate fin, to move said pressure plate back to a position prior to the movement away from the cutter blade, to lower said pressure plate to depress the plate fins along said hairpin pipes toward lower ends thereof after a predetermined number of plate fins have been fitted over said hairpin pipes, thereby stacking said plate fins successively on said hairpin pipes.

* * * * *